US009776227B2

(12) United States Patent
Li et al.

(10) Patent No.: US 9,776,227 B2
(45) Date of Patent: Oct. 3, 2017

(54) FLEXIBLE ROLL-DIE FORMING MACHINE FOR VARIABLE CROSS-SECTION PARTS

(71) Applicant: NORTH CHINA UNIVERSITY OF TECHNOLOGY, Beijing (CN)

(72) Inventors: Qiang Li, Beijing (CN); Zhenfeng Yang, Beijing (CN); Yanzhi Guan, Beijing (CN); Haibo Wang, Beijing (CN); Yu Yan, Beijing (CN)

(73) Assignee: NORTH CHINA UNIVERSITY OF TECHONLOGY, Beijing (CN)

( * ) Notice: Subject to any disclaimer, the term of this patent is extended or adjusted under 35 U.S.C. 154(b) by 284 days.

(21) Appl. No.: 14/438,215

(22) PCT Filed: May 19, 2014

(86) PCT No.: PCT/CN2014/000510

§ 371 (c)(1),
(2) Date: Apr. 23, 2015

(87) PCT Pub. No.: WO2015/123799

PCT Pub. Date: Aug. 27, 2015

(65) Prior Publication Data

US 2016/0023256 A1 Jan. 28, 2016

(30) Foreign Application Priority Data

Feb. 24, 2014 (CN) ..... 2014 1 0061025

(51) Int. Cl.
*B21D 5/08* (2006.01)
*B21B 13/02* (2006.01)

(52) U.S. Cl.
CPC ..... *B21B 13/02* (2013.01); *B21D 5/08* (2013.01); *B21D 5/083* (2013.01)

(58) Field of Classification Search
CPC ..... B21D 5/08; B21D 5/083; B21D 1/026; B21D 1/12; B21D 31/24; B21D 31/32;
(Continued)

(56) References Cited

U.S. PATENT DOCUMENTS 3,914,971 A * 10/1975 Colbath ..... B21D 5/083 72/178
4,558,577 A * 12/1985 Trishevsky ..... B21D 5/083 72/12.7

(Continued)

*Primary Examiner* — Edward Tolan

(57) ABSTRACT

A flexible roll-die forming machine for variable cross-section parts includes: a feeding device and a flexible roll-die forming unit; wherein the flexible roll-die forming unit includes at least a set of flexible roll-die forming devices; when two or more sets of the flexible roll-die forming devices are provided, the flexible roll-die forming devices are connected in sequence; wherein the feeding device is arranged at a front end of the flexible roll-die forming unit and is connected to an adjacent flexible roll-die forming device. The present invention effectively solves problems that conventional flexible roll-die forming machines are not able to produce narrow part with variable cross-sections, and the forming accuracy is poor. The present invention also reduces the amount of shafts controlled by servo motors, so as to simplify the controlling system, improve system operation reliability and simplify maintenance.

9 Claims, 3 Drawing Sheets

(58) Field of Classification Search
CPC .. B21D 5/14; B21B 1/026; B21B 1/12; B21B 31/24; B21B 31/32; B21B 13/02
See application file for complete search history.

(56) References Cited

U.S. PATENT DOCUMENTS

| | | | | | |
|---|---|---|---|---|---|
| 4,716,754 | A * | 1/1988 | Youngs | B21D 5/08 | 72/178 |
| 5,163,311 | A * | 11/1992 | McClain | B21D 5/08 | 72/181 |
| 5,613,390 | A * | 3/1997 | Ishikawa | B21B 1/026 | 72/13.7 |
| 5,740,687 | A * | 4/1998 | Meyer | B21D 5/08 | 226/186 |
| 6,209,374 | B1 * | 4/2001 | Bradbury | B21B 31/24 | 72/181 |
| 6,289,708 | B1 * | 9/2001 | Keinanen | B21D 5/08 | 72/178 |
| 6,647,754 | B2 * | 11/2003 | Bodnar | B21D 5/08 | 72/181 |
| 8,181,499 | B2 * | 5/2012 | Ingvarsson | B21D 5/083 | 72/178 |
| 9,573,318 | B2 * | 2/2017 | Lee | B21D 5/08 | |
| 2010/0326160 | A1 * | 12/2010 | Runyan | B21D 5/083 | 72/181 |
| 2013/0276497 | A1 * | 10/2013 | Ingvarsson | B21D 5/08 | 72/12.8 |

* cited by examiner

FLEXIBLE ROLL-DIE FORMING MACHINE FOR VARIABLE CROSS-SECTION PARTS

CROSS REFERENCE OF RELATED APPLICATION

This is a U.S. National Stage under 35 U.S.C. 371 of the International Application PCT/CN2014/000510, filed May 19, 2014, which claims priority under 35 U.S.C. 119(a-d) to CN 201410061025.2, filed Feb. 24, 2014.

BACKGROUND OF THE PRESENT INVENTION

Field of Invention

The present invention relates to a technical field of flexible roll-die forming technology, and more particularly to a flexible roll-die forming machine with unmovable dies and movable rollers for forming narrow sheet metal parts with variable cross-section.

Description of Related Arts

Conventionally, flexible roll forming technology and developed prototype are able to provide double-side roll forming. However, shape and width of the cross-section are limited. Only varied cross-section parts with large width are able to be formed. In addition, during forming, conventional defects cannot be eliminated, resulting in uncertain forming accuracy. Deep and narrow varied cross-section parts are not able to be formed due to space limitation of the roller. Furthermore, because of different springback angles alone varied cross-section area and constant cross-section area, it is quite difficult to control forming accuracy, which is unavoidable due to lack of effective technical method.

At present, the conventional prototype of variable cross-section roll forming machine relates to space-time cooperative control of multi-axies, therefore, during actual manufacturing, problems such as unstable system, low reliability and complex maintenance will occur.

SUMMARY OF THE PRESENT INVENTION

The goal of the present invention is to provide a flexible roll-die forming machine with unmovable dies and movable rollers, to overcome the above problems.

Accordingly, in order to accomplish the above objective, the present invention provides:

a flexible roll-die forming machine with unmovable dies and movable rollers, comprising: a feeding device and a flexible roll-die forming unit; wherein the flexible roll-die forming unit comprises at least a set of flexible roll-die forming devices; when two or more sets of the flexible roll-die forming devices are provided, the flexible roll-die forming devices are connected in sequence;

wherein the feeding device is arranged at the front end of the flexible roll-die forming unit and is connected to an adjacent flexible roll-die forming device;

wherein the flexible roll-die forming device comprises: a holder (12), a pair of unmovable dies, a bottom die supporter (16), a die opening and closing mechanism, an X-axis moving mechanism, and a Y-axis moving frame; wherein the unmovable dies comprises: a top die (14) and a bottom die (15); wherein the die opening and closing mechanism comprises: a die opening and closing frame, a hydraulic cylinder (9), a Z-axis constrained rolling linear rail pair (8), and a top die connecting beam (13); wherein the die opening and closing frame comprises a die opening and closing column (10) and a cross beam (11);

wherein the die opening and closing column (10) is connected to the holder (12); the hydraulic cylinder (9) is connected to the die opening and closing frame; there are two hydraulic cylinders (9) symmetrically arranged at two sides of the flexible roll-die forming machine; a movable end of the hydraulic cylinder (9) is connected to the top die connecting beam (13);

wherein the Z-axis constrained rolling linear rail pair (8) is mounted on the die opening and closing column (10); there are four Z-axis constrained rolling linear rail pairs (8), each two of the Z-axis constrained rolling linear rail pairs (8) are symmetrically arranged at a front end and a rear end of the flexible roll-die forming device in a face-to-face form;

wherein the top die (14) is connected to the top die connecting beam (13), the bottom die (15) is connected to the bottom die supporter (16); the bottom die (15) is unmovable; the top die (14) is driven by the hydraulic cylinder (9), so as to move up and down along a Z-axis for die opening and closing.

The X-axis moving mechanism is symmetrically arranged on the holder; the X-axis moving mechanism on each side comprises: an X-axis driving mechanism, an X-axis moving holder and an X-axis rolling linear rail pair (17);

wherein the X-axis driving mechanism comprises: an X-axis moving servo motor (22), an X-axis planetary gear reducer (21) and a bevel gear (20);

wherein the X-axis moving holder comprises: an X-axis moving base (18) and a bevel rack (19); wherein a bottom end of the X-axis moving base (18) is connected to the bevel rack (19) through a screw bolt, and is mounted on the holder (12) through the X-axis rolling linear rail pair (17); the bevel rack (19) is engaged with the bevel gear (20).

There are 2A sets of the Y-axis moving frames, each A set forms a unit symmetrically arranged on the X-axis moving base (18) and serves as A pass forming frames, and are connected to the X-axis moving base (18), wherein A is a natural number larger than one;

wherein each set of the Y-axis moving frames comprises: a Y-axis moving servo motor (30), a Y-axis planetary gear reducer (29), a ball screw, a screw box (28), a Y-axis rolling linear rail pair (27), a top forming frame, an adaptive spring (25), a roller driving servo motor, a roller planetary gear reducer (24), a gear pair, and a forming roller;

wherein the Y-axis moving servo motor (30), the Y-axis planetary gear reducer (29) and the ball screw are installed on the screw box (28); the Y-axis rolling linear rail pair (27) is mounted at a top portion of the screw box (28); the top forming frame is mounted on the sliders of the Y-axis rolling linear rail pair (27); the forming roller is mounted on the Y-axis moving frame, the Y-axis moving servo motor (30) through the ball screw drives the forming roller and the Y-axis moving frame to move along Y-axis.

A pretightening force of the adaptive springs are adjustable according to the forming force of the metal strip, when the forming force is larger than the pretightening force, the adaptive springs are adaptively compressed to protect the Y-axis moving servo motor and the ball screw.

A equals to five, first four pass forming frames are the same, and a roll-forming angle of a fifth pass forming frame is adjustable according to different springback angles between a flexible area and a constant cross-section area of a part.

The feeding device comprises: a strip driving mechanism, a width adjusting and a centering constraining mechanism (3);

wherein the strip driving mechanism comprises: a first strip driving mechanism mounted at a front end of the feeding device, and a plurality of second strip driving mechanisms mounted on front ends and rear ends of each set of the flexible roll-die forming devices;

wherein the width adjusting and centering constraining mechanism (3) comprises: a thickness limiting roller (4) and a width limiting roller (5); wherein a center-to-center distance of the thickness limiting roller (4) is adjustable according to the thickness of a strip; a center-to-center distance of the width limiting roller (5) is adjustable according to the width of the strip; the thickness limiting roller (4) supports the strip, and the width limiting roller (5) centers and limits the strip along Y-axis.

The strip driving mechanism further comprises: two driving mechanism servo motors, a driving mechanism planetary gear reducer, a driving roller and a rolling gap adjusting mechanism; wherein the first strip driving mechanism at the front end of the feeding device is driven from a bottom side thereof by one servo motor; the second strip driving mechanisms on the front ends and the rear ends of each set of the flexible roll-die forming devices are all driven from top sides and bottom sides thereof by two servo motors.

The flexible roll-die forming machine further comprises at least a set of constant cross-section roll-die forming devices, wherein the constant cross-section roll-die forming devices are arranged behind the flexible roll-die forming unit, and are connected to adjacent flexible roll-die forming devices; when two or more sets of the constant cross-section roll-die forming devices are provided, the constant cross-section roll-die forming devices are connected in sequence.

The hydraulic cylinder (9) is connected to the die opening and closing frame through a first universal joint; the movable end of the hydraulic cylinder (9) is connected to the top die connecting beam (13) through a second universal joint and a bolt.

According to the present invention, the flexible roll-die forming device and the constant cross-section roll-die forming device can be one or more units. The amount of the flexible roll-die forming devices and the constant cross-section roll-die forming devices are adjustable according to parts to be formed.

Advantages of the present invention are as follows.

1) The present invention effectively solves problems that conventional flexible roll-die forming machines are not able to produce narrow flexible sheet metal, and the forming accuracy is poor.

2) The present invention reduces the amount of shafts controlled by servo, so as to simplify the controlling system, improve system operation reliability and simplify maintenance.

Figure 1:
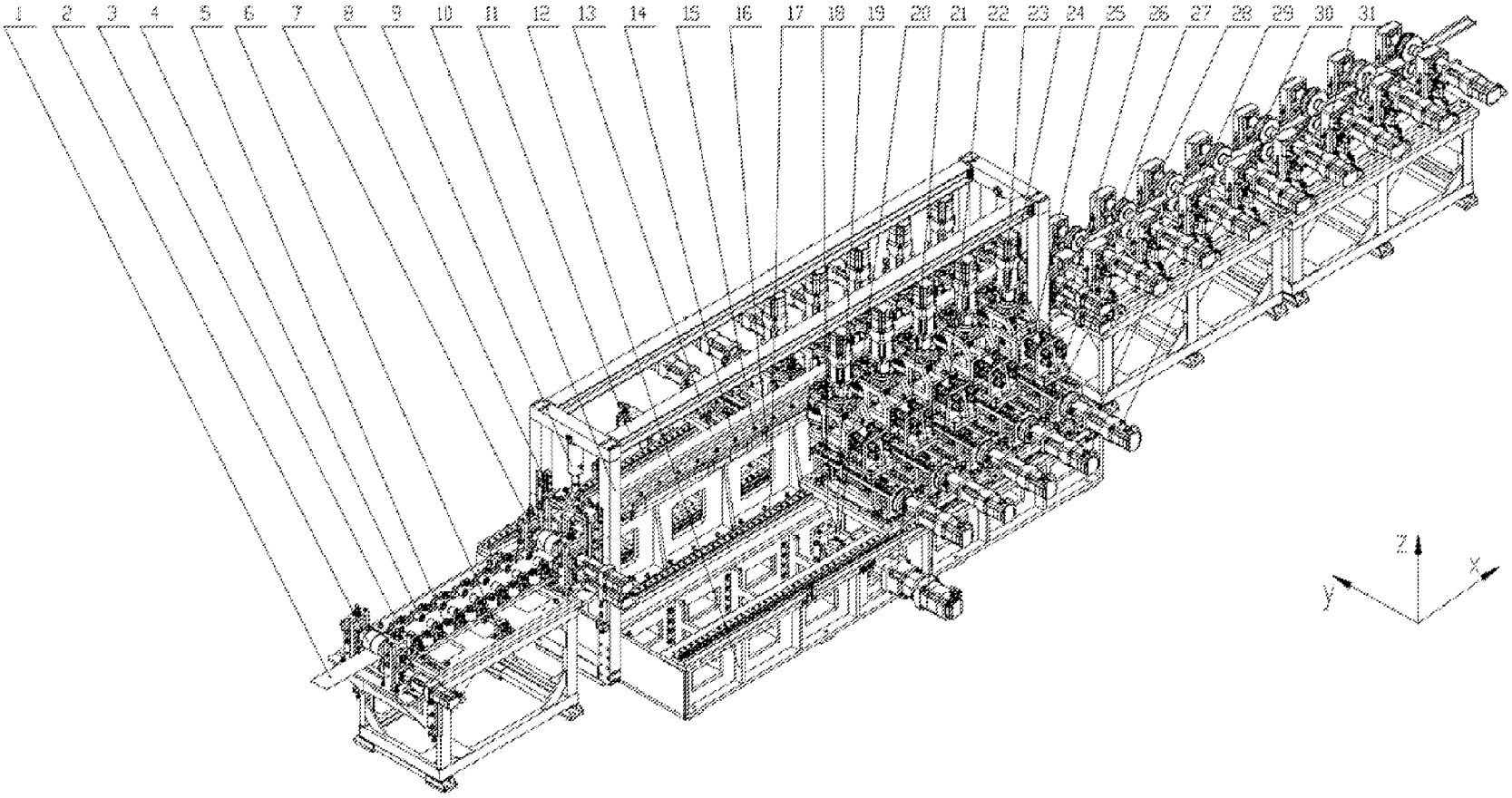
FIG. 1 is a perspective view of a flexible roll-die forming machine with unmovable dies and movable rollers according to the present invention.

Element reference: 1—forming strip, 2—first strip bottom shaft single-driving frame, 3—width adjusting and centering constraining mechanism, 4—thickness limiting roller, 5—width limiting roller, 6—strip width adjusting nut, 7—second strip top and bottom shafts double-driving frame, 8—Z-axis constrained rolling linear rail pair, 9—hydraulic cylinder, 10—die opening and closing column, 11—cross beam, 12—holder, 13—top die connecting beam, 14—top die, 15—bottom die, 16—bottom die supporter, 17—X-axis rolling linear rail pair, 18—X-axis moving base, 19—bevel rack, 20—bevel gear, 21—X-axis planetary gear reducer, 22—X-axis moving servo motor, 23—roller driving servo motor, 24—roller planetary gear reducer, 25—adaptive spring, 26—third strip top and bottom shafts double-driving frame, 27—Y-axis rolling linear rail pair, 28—screw box, 29—Y-axis planetary gear reducer, 30—Y-axis moving servo motor, 31—constant cross-section roll-die forming frame section, 32—forming roller, 33—correlation optical fiber switch sensor, 34—first photoelectric switch, 35—first travel switch, 36—second travel switch, 37—second photoelectric switch.

DETAILED DESCRIPTION OF THE PREFERRED EMBODIMENT

One skilled in the art will understand that the embodiment of the present invention as shown in the drawings and described below is exemplary only and not intended to be limiting.

Figure 2:
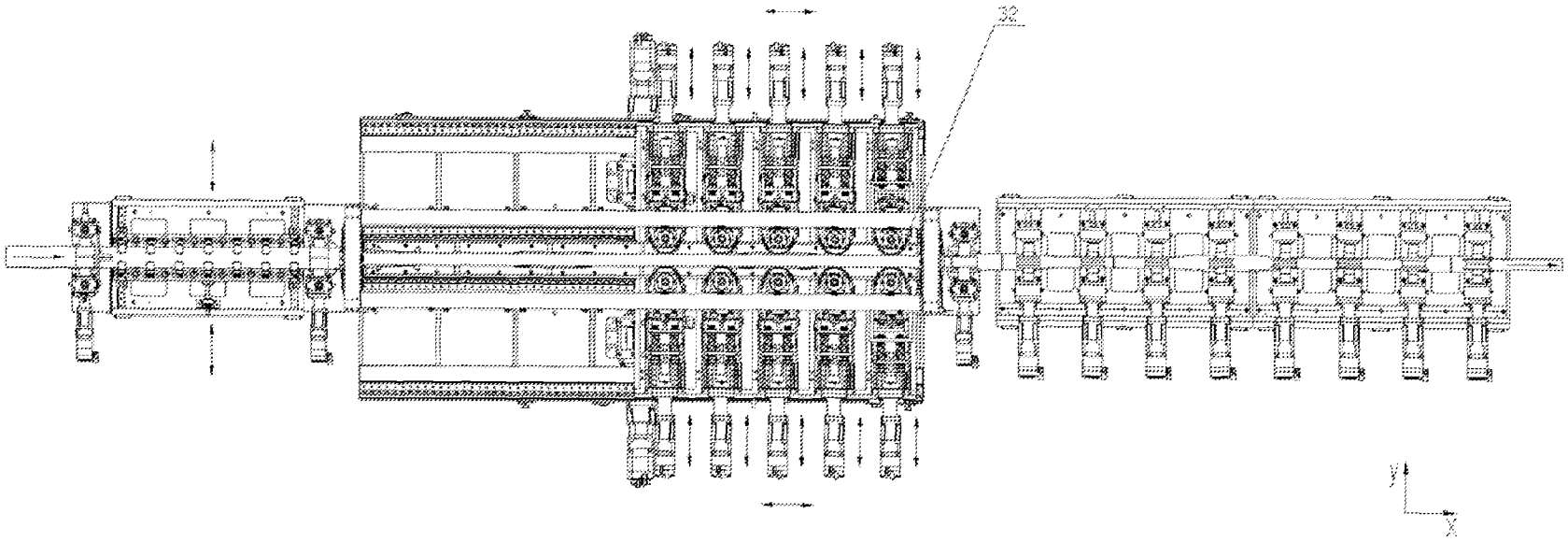
FIG. 2 is a top view of the FIG. 1.
Figure 3:
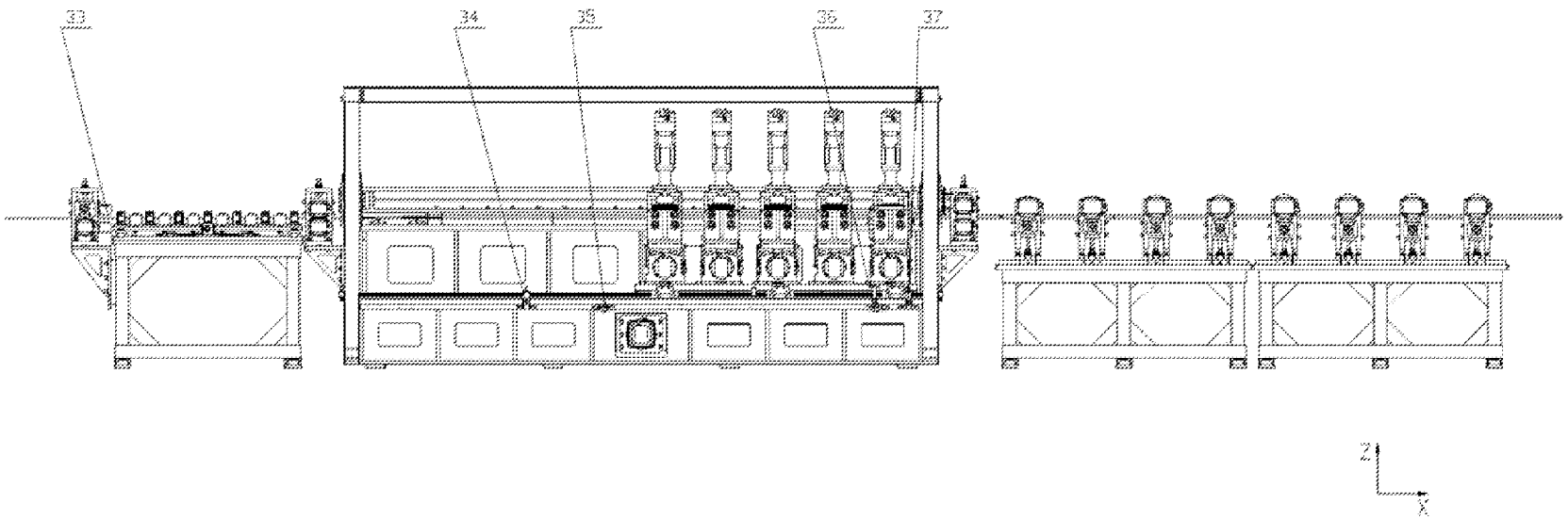
FIG. 3 is a front view of the FIG. 1.

Referring to FIGS. 1-3 of the drawings, a flexible roll-die forming machine with unmovable dies and movable rollers is illustrated, comprising:

a feeding device and a flexible roll-die forming unit; wherein the flexible roll-die forming unit comprises at least a set of flexible roll-die forming devices; when two or more sets of the flexible roll-die forming devices are provided, the flexible roll-die forming devices are connected in sequence; wherein the feeding device is arranged at a front end of the flexible roll-die forming unit and is connected to an adjacent flexible roll-die forming device; wherein the flexible roll-die forming device comprises: a holder 12, unmovable dies, a bottom die supporter 16, a die opening and closing mechanism, an X-axis moving mechanism, and a Y-axis moving frame; wherein the unmovable dies comprises: a top die 14 and a bottom die 15; wherein the die opening and closing mechanism comprises: a die opening and closing frame, a hydraulic cylinder 9, a Z-axis constrained rolling linear rail pair 8, and a top die connecting beam 13; wherein the die opening and closing frame comprises a die opening and closing column 10 and a cross beam 11; wherein the die opening and closing column 10 is connected to the holder 12; the hydraulic cylinder 9 is connected to the die opening and closing frame; there are two hydraulic cylinders 9 symmetrically arranged at two sides of the flexible roll-die forming machine; a movable end of the hydraulic cylinder 9 is connected to the top die connecting beam 13; wherein the Z-axis constrained rolling linear rail pair 8 is mounted on the die opening and closing column 10; there are four Z-axis constrained rolling linear rail pairs 8, each two of the Z-axis constrained rolling linear rail pairs 8 are symmetrically arranged at a front end and a rear end of the flexible roll-die forming device in a face-to-face form; wherein the top die 14 is connected to the top die connecting beam 13, the bottom die 15 is connected to the bottom die supporter 16; the bottom die 15 is unmovable; the top die 14 is driven by the hydraulic cylinder 9, so as to move up and down along a Z-axis for die opening and closing.

Preferably, the X-axis moving mechanism is symmetrically arranged on the holder 12; the X-axis moving mechanism on each side comprises: an X-axis driving mechanism, an X-axis moving holder and an X-axis rolling linear rail pair 17; wherein the X-axis driving mechanism comprises: an X-axis moving servo motor 22, an X-axis planetary gear reducer 21 and a bevel gear 20; wherein the X-axis moving holder comprises: an X-axis moving base 18 and a bevel rack 19; wherein a bottom end of the X-axis moving base 18 is connected to the bevel rack 19 through a screw bolt, and is mounted on the holder 12 through the X-axis rolling linear rail pair 17; the bevel rack 19 is engaged with the bevel gear 20.

Preferably, there are 2A sets of the Y-axis moving frames, each A set forms a unit symmetrically arranges on the X-axis moving base 18 as the A pass forming frames, and are connected by bolts to the X-axis moving base 18, wherein A is a natural number larger than one; wherein each set of the Y-axis moving frames comprises: a Y-axis moving servo motor 30, a Y-axis planetary gear reducer 29, a ball screw, a screw box 28, a Y-axis rolling linear rail pair 27, a top forming frame, an adaptive spring 25, a roller driving servo motor 23, a roller planetary gear reducer 24, a gear pair, and a forming roller; wherein the Y-axis moving servo motor 30, the Y-axis planetary gear reducer 29 and the ball screw are installed on the screw box 28; the Y-axis rolling linear rail pair 27 is mounted at a top portion of the screw box 28; the top forming frame is mounted on the sliders of the Y-axis rolling linear rail pair 27; the forming roller is mounted on the Y-axis moving frame, the Y-axis moving servo motor 30 through the ball screw drives the forming roller and the Y-axis moving frame to move along Y-axis.

A pretightening force of the adaptive springs 25 are adjustable according to the forming force of the metal strip, when the forming force is larger than the pretightening force, the adaptive springs 25 are adaptively compressed to protect the Y-axis moving servo motor 30 and the ball screw.

A equals to five, first four pass forming frames are the same, and a roll-forming angle of a fifth pass forming frame is adjustable according to different springback angles between the flexible area and the constant cross-section area of a part.

Preferably, the feeding device comprises: a strip driving mechanism, and a width adjusting and centering constraining mechanism 3; wherein the strip driving mechanism comprises: a first strip driving mechanism mounted at a front end of the feeding device, and a plurality of second strip driving mechanisms mounded on front ends and rear ends of each set of the flexible roll-die forming devices; wherein the width adjusting and centering constraining mechanism 3 comprises: a thickness limiting roller 4 and a width limiting roller 5; wherein a center-to-center distance of the thickness limiting roller 4 is adjustable according to the thickness of a strip; a center-to-center distance of the width limiting roller 5 is adjustable according to the width of the strip; the thickness limiting roller 4 supports the strip, and the width limiting roller 5 centers and limits the strip along Y-axis.

The strip driving mechanism further comprises: two driving mechanism servo motors, a driving mechanism planetary gear reducer, a driving roller and a rolling gap adjusting mechanism; wherein the first strip driving mechanism at the front end of the feeding device is driven from a bottom side thereof by one servo motor; the second strip driving mechanisms on the front ends and the rear ends of each set of the flexible roll-die forming devices are all driven from top sides and bottom sides thereof by two servo motors.

Preferably, the flexible roll-die forming machine further comprises at least a set of constant cross-section roll-die forming devices, wherein the constant cross-section roll-die forming devices are arranged behind the flexible roll-die forming unit, and are connected to adjacent flexible roll-die forming devices; when two or more sets of the constant cross-section roll-die forming devices are provided, the constant cross-section roll-die forming devices are connected in sequence.

Preferably, the hydraulic cylinder 9 is connected to the die opening and closing frame through a first universal joint; the movable end of the hydraulic cylinder 9 is connected to the top die connecting beam 13 through a second universal joint.

Therefore, according to the present invention, the flexible roll-die forming machine comprises: the feeding device and the flexible roll-die forming devices. The feeding device is arranged at the front end of the flexible roll-die forming device and is connected to the flexible roll-die forming devices. The feeding device comprises the strip driving mechanism, and the width adjusting and centering constraining mechanism 3. The flexible roll-die forming device comprises: the unmovable dies, the die opening and closing mechanism, the X-axis moving mechanism, the Y-axis moving frame and the forming roller. The die opening and closing mechanism comprises: the hydraulic cylinders 9, limiting rails, the top die connecting beam 13, and the die opening and closing frame. The hydraulic cylinders 9 are arranged at two sides of the flexible roll-die forming device, and are connected to the top die connecting beam 13. The flexible roll-die forming device comprises five forming passes, wherein each forming pass comprises two individual forming frames; there are overall 10 forming frames. Every five forming frames are a unit, which is arranged on an X-axis moving holder. Meanwhile, each forming frame is driven by a servo motor for individually moving along the Y-axis, in such a manner that by controlling rotation of the servo motor, a roller moves along the contour of the unmovable die for flexible forming of the metal strip. The present invention effectively solves the problem of producing narrow varied cross-section metal strip, as well as greatly reduces original defects during flexible roll-die forming for improving accuracy of the parts. According to the present invention, the adaptive spring is used, and there is no need for the forming passes to work cooperatively during forming, which lowers controlling scale and difficulty, and satisfies actual manufacturing requirements.

According to the present invention, a forming strip 1 is processed by an uncoiler, a leveler and a punching edge-cutter, and then driven by a first strip bottom shaft single-driving frame to enter a width adjusting and centering constraining mechanism 3. The forming strip 1 passes a thickness limiting roller 4, and is supported by the thickness limiting roller 4. There are seven pairs of the thickness limiting rollers 4, which are bilateral-symmetrically arranged, and are mounted on an adjusting board of the width adjusting and centering constraining mechanism 3 by a bolt. Each thickness limiting roller 4 comprises an upper roller and a lower roller, wherein the lower roller is unmovable and the upper roller is adjustable along the Z-axis, so as to adjust a center-to-center distance between the upper roller and the lower roller according to the thickness of the metal strip 1. Two wide-edges of the metal strip 1 are in contact with a width limiting roller 5. There are six pairs of the width limiting rollers 5, which are bilateral-symmetrically arranged, and are mounted on the adjusting board of the width adjusting and centering constraining mechanism 3 by a bolt. By adjusting a strip width adjusting nut 6, a center-to-center distance of the width limiting roller 5 are adjusted for suiting different widths. After adjusting the center-to-center distance of the width limiting roller 5, a position thereof is fixed by a bolt.

According to the present invention, the hydraulic cylinder 9 is mounted between the die opening and closing column 10. The die opening and closing columns 10 are respectively mounted at a front end and a rear end of the holder 12 by bolts. A bottom portion of the hydraulic cylinder 9 is connected to the top die connecting beam 13 by a bolt. The top die 14 is connected to a bottom portion of the top die connecting beam 13. Therefore, the hydraulic cylinder 9 is able to drive the top die 14 to move up and down, i.e. the opening and closing function. The Z-axis constrained rolling linear rail pair 8 is mounted at an inner side of each die opening and closing column 10 for supporting and positioning die opening and closing.

According to the present invention, the bottom die 15 is mounted on the bottom die supporter 16 by a bolt. The bottom die supporter 16 is connected to the holder 12 by a bolt. During die opening, the top die 14 is lifted by the hydraulic cylinder 9, and the metal strip 1 is sent to a place between the top die 14 and the bottom die 15 by the first strip bottom shaft single-driving frame 2, the second strip top and bottom shafts double-driving frame 7 and a third strip top and bottom shafts double-driving frame 26.

According to the present invention, the bevel gear 20, the X-axis planetary gear reducer 21 and the X-axis moving servo motor 22 are assembled as an individual module, and are symmetrically mounted at a left end and a right end of the holder 12 by bolts.

According to the present invention, the X-axis moving base 18 is bilateral-symmetrically mounted on the holder 12 through the X-axis rolling linear rail pair 17. The X-axis moving base 18 is connected to the bevel rack 19 through a bolt. The bevel gear 20 is engaged with the bevel rack 19 for controlling the X-axis moving servo motor 22, so as to drive the X-axis moving base 18 along the X-axis.

According to the present invention, the forming frame is formed by the roller driving servo motor 23, the roller planetary gear reducer 24, the adaptive spring 25, the Y-axis rolling linear rail pair 27, the screw box 28, the Y-axis planetary gear reducer 29, the Y-axis moving servo motor 30 and the forming roller 32, and is connected to the X-axis moving base 18 through a bolt. There are 10 sets of the forming frames, and each 2 sets are bilateral-symmetrically arranged and forms 5 forming passes.

According to the present invention, the Y-axis moving servo motor 30 is decelerated by the Y-axis planetary gear reducer 29 and driven by the ball screw, for moving the forming roller 32 along the Y-axis. In addition, the forming frame is mounted on the X-axis moving base, so as to move the forming roller 32 along the X-axis.

According to the present invention, 4 sets of the adaptive springs 25 are mounted on each forming frame. The pre-tightening force of the adaptive springs 25 is adjustable according to the forming force of the metal strip.

According to the present invention, with the hydraulic cylinder 9, the top die 14 and the bottom die 15 are closed for pressing the metal strip 1. At the same time, the forming roller 32 is driven to move along the contour of the top die 14 by the X-axis moving servo motor 22, the roller driving servo motor 23 and the Y-axis moving servo motor 30. After an X-axis moving distance of the forming roller 32 is larger than a part length, the top die 14 is separated from the bottom die 15, the forming roller 32 is reset, and the metal strip 1 is moved one part length forward by the first strip bottom shaft single-driving frame 2, the second strip top and bottom shafts double-driving frame 7 and the third strip top and bottom shafts double-driving frame 26. Then the top die 14 and the bottom die 15 close again, and the above processes are repeated.

According to the present invention, a correlation optical fiber switch sensor 33 detects feature holes to detect whether the metal strip 1 is moved one part length forward. A zero-point and the X-axis moving distance of the forming roller 32 are determined according to a first photoelectric switch 34 and a second photoelectric switch 37. A max position of the forming roller 32 is determined by a first travel switch 35, a second travel switch 36 and a travel switch on the screw box 28.

According to the present invention, the flexible roll-die forming device is able to form a U-sharp varied cross-section strip material. If a height of a part is varied, units such as the constant cross-section roll-die forming frame portion 31 may be added to the flexible roll-die forming device for forming.

According to the present invention, the top die 14 is able to be narrower. Therefore, the present invention is able to form a varied cross-section part with a deep and narrow cross-section. The top die 14 is easily replaceable to suit different parts, and the cost thereof is low due to being convex.

According to the present invention, the forming roller 32 of the fifth pass forming frame is adaptive according to a surface angle of the top die 14, so as to solve a problem of different springback angles between the varied cross-section area and the constant cross-section area.

According to the present invention, for obtaining a final product, assisting devices such as a cutter may be necessary.

Therefore, the present invention provides a flexible roll-die forming machine with an unmovable die and a movable roller, which is able to form varied cross-section strip parts with deep and narrow cross-sections. Because the dies guarantee the forming accuracy and the forming angle of the roller is adaptive, forming quality according to the present invention is greatly improved compared with the conventional flexible roll-die forming. According to the present invention, the adaptive spring is used, and there is no need for the forming passes to work cooperatively during forming, which lowers controlling scale and difficulty and satisfies actual manufacturing requirements.

It can be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A flexible roll-die forming machine with dies and movable rollers, comprising: at least a feeding device and a flexible roll-die forming unit; when two or more sets of flexible roll-die forming devices are provided, said flexible roll-die forming devices are connected in sequence;

wherein said feeding device is arranged at the front end of said flexible roll-die forming unit and is connected to an adjacent flexible roll-die forming device;

wherein said flexible roll-die forming device comprises: a holder (12), dies, a bottom die supporter (16), a die opening and closing mechanism, an X-axis moving mechanism, and a Y-axis moving frame; wherein said dies comprises: a top die (14) and a bottom die (15);

wherein said die opening and closing mechanism comprises: a die opening and closing frame, a hydraulic cylinder (9), a Z-axis constrained rolling linear rail pair (8), and a top die connecting beam (13); wherein said die opening and closing frame comprises a die opening and closing column (10) and a cross beam (11);

wherein said die opening and closing column (10) is connected to said holder (12); said hydraulic cylinder (9) is connected to said die opening and closing frame; there are two hydraulic cylinders (9) symmetrically arranged at two sides of said flexible roll-die forming machine; a movable end of said hydraulic cylinder (9) is connected to said top die connecting beam (13);

wherein said Z-axis constrained rolling linear rail pair (8) is mounted on said die opening and closing column (10); there are four Z-axis constrained rolling linear rail pairs (8), each two of said Z-axis constrained rolling linear rail pairs (8) are symmetrically arranged at a front end and a rear end of said flexible roll-die forming device in a face-to-face form;

wherein said top die (14) is connected to said top die connecting beam (13), said bottom die (15) is connected to said bottom die supporter (16); said bottom die (15) is unmovable; said top die (14) is driven by said hydraulic cylinder (9), so as to move up and down along a Z-axis for die opening and closing.

2. The flexible roll-die forming machine, as recited in claim 1, wherein said X-axis moving mechanism is symmetrically arranged on said holder (12); said X-axis moving mechanism on each side comprises: an X-axis driving mechanism, an X-axis moving holder and an X-axis rolling linear rail pair (17);

wherein said X-axis driving mechanism comprises: an X-axis moving servo motor (22), an X-axis planetary gear reducer (21) and a bevel gear (20);

wherein said X-axis moving holder comprises: an X-axis moving base (18) and a bevel rack (19); wherein a bottom end of said X-axis moving base (18) is connected to said bevel rack (19) through a screw bolt, and is mounted on said holder (12) through said X-axis rolling linear rail pair (17); said bevel rack (19) is engaged with said bevel gear (20).

3. The flexible roll-die forming machine, as recited in claim 1, wherein there are 2A sets of said Y-axis moving frames, each A set forms a unit symmetrically arranged on said X-axis moving base (18) and serves as A pass forming frames, and are connected to said X-axis moving base (18), wherein A is a natural number larger than one;

wherein each set of said Y-axis moving frames comprises: a Y-axis moving servo motor (30), a Y-axis planetary gear reducer (29), a ball screw, a screw box (28), a Y-axis rolling linear rail pair (27), a top forming frame, an adaptive spring (25), a roller driving servo motor (23), a roller planetary gear reducer (24), a gear pair, and a forming roller;

wherein said Y-axis moving servo motor (30), said Y-axis planetary gear reducer (29) and said ball screw are installed on said screw box (28); said Y-axis rolling linear rail pair (27) is mounted at a top portion of said screw box (28); said top forming frame is mounted on the sliders of the said Y-axis rolling linear rail pair (27); said forming roller is mounted on said Y-axis moving frame, said Y-axis moving servo motor (30) through said ball screw drives said forming roller and said Y-axis moving frame to move along Y-axis.

4. The flexible roll-die forming machine, as recited in claim 3, wherein a pretightening force of said adaptive springs (25) are adjustable according to the forming force of a metal strip, when said forming force is larger than said pretightening force, said adaptive springs (25) are adaptively compressed for protecting said Y-axis moving servo motor (30) and said ball screw.

5. The flexible roll-die forming machine, as recited in claim 3, wherein A equals to five, first four pass forming frames are the same, and a roll-die forming angle of a fifth pass forming frame is adjustable according to different springback angles between the flexible area and the constant cross-section area of a part.

6. The flexible roll-die forming machine, as recited in claim 1, wherein said feeding device comprises: a strip driving mechanism, and a width adjusting and centering constraining mechanism (3);

wherein said strip driving mechanism comprises: a first strip driving mechanism mounted at a front end of said feeding device, and a plurality of second strip driving mechanisms mounted on front ends and rear ends of each set of said flexible roll-die forming devices;

wherein said width adjusting and centering constraining mechanism (3) comprises: a thickness limiting roller (4) and a width limiting roller (5); wherein a center-to-center distance of said thickness limiting roller (4) is adjustable according to the thickness of a strip; a center-to-center distance of said width limiting roller (5) is adjustable according to a width of said strip; said thickness limiting roller (4) supports said strip, and said width limiting roller (5) centers and limits said strip along a Y-axis.

7. The flexible roll-die forming machine, as recited in claim 6, wherein said strip driving mechanism further comprises: two driving mechanism servo motors, a driving mechanism planetary gear reducer, a driving roller and a rolling gap adjusting mechanism; wherein said first strip driving mechanism as said front end of said feeding device is driven from a bottom side thereof by one servo motor; said second strip driving mechanisms on said front ends and said rear ends of each set of said flexible roll-die forming devices are all driven from top sides and bottom sides thereof by two servo motors.

8. The flexible roll-die forming machine, as recited in claim 1, further comprising at least a set of constant cross-section roll-die forming devices, wherein said constant cross-section roll-die forming devices are arranged behind said flexible roll-die forming unit, and are connected to adjacent flexible roll-die forming devices; when two or more sets of said constant cross-section roll-die forming devices are provided, said constant cross-section roll-die forming devices are connected in sequence.

9. The flexible roll-die forming machine, as recited in claim 1, wherein said hydraulic cylinder (9) is connected to said die opening and closing frame through a first universal joint; said movable end of said hydraulic cylinder (9) is connected to said top die connecting beam (13) through a second universal joint.

* * * * *